US005976459A

United States Patent [19]

Eisen et al.

[11] Patent Number: 5,976,459

[45] Date of Patent: Nov. 2, 1999

[54] METHOD FOR COMPACTING HIGH ALLOY TOOL STEEL PARTICLES

[75] Inventors: William B. Eisen, Pittsburgh, Pa.; Walter Haswell, Jamesville, N.Y.; Kenneth J. Wojslaw, Syracuse, N.Y.; Jeryl K. Wright, Camillus, N.Y.

[73] Assignee: Crucible Materials Corporation, Syracuse, N.Y.

[21] Appl. No.: 09/003,368

[22] Filed: Jan. 6, 1998

[51] Int. Cl.[6] ..... B22F 3/14; B22F 3/16

[52] U.S. Cl. ..... 419/49; 419/54; 419/55; 419/60

[58] Field of Search ..... 419/49, 54, 55, 419/60

[56] References Cited

U.S. PATENT DOCUMENTS

| | | | |
|---|---|---|---|
| 5,447,800 | 9/1995 | Dorsch et al. | 428/552 |
| 5,453,242 | 9/1995 | Knoess | 419/27 |
| 5,538,683 | 7/1996 | Pinnow et al. | 419/49 |
| 5,679,908 | 10/1997 | Pinnow et al. | 75/246 |

OTHER PUBLICATIONS

"Mechanical Fumdamentals of Consolidation," Fritz V. Lenel, *Metals Handbook Ninth Edition, vol. 7, Powder Metallurgy*, American Society of Metals, pp. 296–308, 1984.

"Physical Fundamentals of Consolidation," Fritz V. Lenel et al., *Metals Handbook Ninth Edition, vol. 7, Powder Metallurgy*, American Society of Metals, pp. 308–321, 1984.

"Hot Isostatic Pressing of Metal Powders," Peter E. Price et al., *Metals Handbook Ninth Edition, vol. 7, Powder Metallurgy*, American Society of Metals, pp. 419–443, 1984.

"Cold Isostatic Pressing of Metal Powders," Peter E. Price et al., *Metals Handbook Ninth Edition, vol. 7, Powder Metallurgy*, American Society of Metals, pp. 444–450, 1984.

"P/M Tool Steels," Ralph W. Stevenson, *Metals Handbook Ninth Edition, vol. 7, Powder Metallurgy*, American Society of Metals, pp. 794,793, 1984.

"Influence of Steel Cleanliness on the Fracture of PM High Speed Steels and Tool Steels," P. Hasselstrom et al., Proc. from the PM 92 World Congress, San Francisco, CA, U.S.A., pp. 423–437, Jun. 1992.

*Primary Examiner*—Daniel J. Jenkins

*Attorney, Agent, or Firm*—Finnegan, Henderson Farabow, Garrett & Dunner L.L.P.

[57] ABSTRACT

A method for producing compacted, fully dense articles from atomized tool steel alloy particles by placing the particles in an evacuated, deformable container, and isostatically pressing the particles at an elevated temperature to produce a precompact having an intermediate density. The precompact is heated to a temperature above the elevated temperature used to produce the precompact. The precompact is isostatically pressed to produce the fully-dense article.

24 Claims, No Drawings

METHOD FOR COMPACTING HIGH ALLOY TOOL STEEL PARTICLES

BACKGROUND OF THE INVENTION

1. Field of the Invention

The invention relates to a method for producing compacted, fully-dense articles from atomized, tool steel alloy particles by isostatic pressing at elevated temperatures.

2. Brief Description of the Prior Art

In the production of powder-metallurgy produced tool steel alloys by hot isostatic compaction, it is necessary to employ sophisticated, expensive melting practices, such as vacuum melting, to limit the quantity of non-metallic constituents, such as oxides and sulfides to ensure attainment of desired properties, such as bend-fracture strength, with respect to tool steel articles made from these alloys. Practices used in addition to vacuum melting to limit the non-metallic content of the steel include using a wtundish or like practices to remove non-metallics prior to atomization of the molten steel to form the alloy particles for compacting, and close control of the starting materials to ensure a low non-metallic content therein. These practices, as well as vacuum melting, add considerably to the overall manufacturing costs for articles of this type.

SUMMARY OF THE INVENTION

It is accordingly an object of the present invention to provide a method for producing compacted, fully-dense articles from atomized tool steel alloy particles that achieve final, compacted articles of reduced oxide content without resorting to the expensive prior art practices used for this purpose.

In accordance with the invention, a method is provided for producing compacted, fully-dense articles from atomized tool steel alloy particles that includes placing the atomized particles in an evacuated deformable container, sealing the container and isostatically pressing the particles within the sealed container at an elevated temperature to form a precompact. The elevated temperature may be up to 1800° F. or 1600° F. This pressing may be performed in the absence of prior outgassing of the powder-filled container. The precompact is heated to a temperature above the elevated temperature used to produce this precompact and is then isostatically pressed to produce the fully-dense article. The fully-dense article may have a minimum bend fracture strength of 500 ksi after hot working.

The heating of the particles to elevated temperature and/or the heating of the precompact may be performed outside of the autoclave that is used for the isostatic pressing.

The atomized tool steel alloy particles may be gas-atomized particles which may be nitrogen gas-atomized particles.

Prior to isostatic pressing, the tool steel alloy particles may be provided within a sealable container. This container is evacuated to provide a vacuum therein. In addition, the deformable container is evacuated to produce a vacuum therein. The alloy particles are introduced from the evacuated container to the evacuated deformable container through an evacuated conduit. The alloy particles are isostatically pressed within the deformable container at an elevated temperature to produce the precompact having an intermediate density. The precompact is heated to a temperature above the elevated temperature used to produce the precompact and the heated precompact is isostatically pressed to produce the fully-dense article.

"Tool steel" is defined to include high speed steel.

The term "intermediate density" means a density greater than tap density but less than full density (for example up to 15% greater than tap density to result in a density of 70 to 85% of theoretical density).

The term "outgassing" is defined as a process in which powder particles are subjected to a vacuum to remove gas from the particles and spaces between the particles.

The term "evacuated" means an atmosphere in which substantially all air has been mechanically removed or an atmosphere in which all air has been mechanically removed and replaced with nitrogen.

DETAILED DESCRIPTION OF THE PREFERRED EMBODIMENTS

By way of demonstration of the invention, a series of experiments was conducted using prealloyed powder. This powder, after mechanical sizing was placed in a container that was in turn connected to a deformable container through a vacuum connection. Both containers were independently evacuated, and then the powder was loaded by use of a vibratory feeder into the deformable container. After this container was filled, it was subsequently sealed and then consolidated. Consolidation was achieved by placing the container filled with powder into a pressure vessel having internal heating capability, sealing the pressure vessel, and simultaneously raising both the temperature and pressure in the vessel to a designated high value for each—typically about 2100° F. and 14,000 psi. This process is known as hot isostatic pressing (HIP). Another consolidation method (also HIP) is to heat the sealed container externally to the designated high temperature, transfer it to a pressure vessel, seal the pressure vessel, and raise the pressure quickly to the designated high value. The method of this invention involves a novel method of consolidation which is a two step process: (1) heating the loaded container to an elevated temperature and pre-compacting it to an intermediate density followed by (2) heating it to the high temperature and hot isostatically pressing it at the temperature and pressure parameters previously described. The elevated temperature for the pre-compaction step can be up to 1800° F. This pre-compaction step increases the density of the powder, but not to full density.

The tested alloys were designated as CPM 10 V (10 V), CPM M4 High Carbon (M4HC), and CPM M4 High Carbon with Sulfur (M4HCHS).

TABLE 1

Composition of Alloys Tested (Balance Fe)

| Alloy | C | Mn | Si | S | Cr | Mo | W | V |
|---|---|---|---|---|---|---|---|---|
| 10 V | 2.45 | 0.50 | 0.90 | 0.07 | 5.25 | 1.30 | — | 9.75 |
| M4HC | 1.40 | 0.30 | 0.30 | 0.05 | 4.00 | 5.25 | 5.75 | 4.00 |
| M4HCHS | 1.42 | 0.70 | 0.55 | 0.22 | 4.00 | 5.25 | 5.75 | 4.00 |

All tests started with containers having a minimum diameter of 14 inches, and were conducted on material that had been hot worked with a reduction in area of at least 75%. M4 types were solution heat treated at 2200° F. and triple tempered at 1025° F. The data are presented by powder type, alloy, and consolidation method. The conventional consolidation method in which the temperature and pressure are simultaneously raised is designated as "CCMD HIP." The process of externally heating, transferring to the pressure vessel, and raising the pressure is designated at "CSMD HIP." The method of the invention as described in the preceding paragraph is designated as "WIP/HIP."

Table 2 presents data from trials of the alloy designated as M4HCHS. The practice used to produce this alloy powder comprised melting raw materials in an induction furnace, adjusting the chemistry of the molten alloy prior to atomization, pouring the molten alloy into a tundish with a refractory nozzle at the base of the tundish, and subjecting the liquid metal stream from that nozzle to high pressure nitrogen gas for atomization thereof, to produce spherical powder particles.

TABLE 2

| M4HCHS | | | | | |
|---|---|---|---|---|---|
| | | | Bend Fracture Results | | |
| Trial Number | Powder Size | Consolidation Method | Tests | Average (ksi) | Max., Min. (ksi) |
| MFG 17 | −16 Mesh | CCMD HIP | 6 | 434 | 458,382 |
| MFG 18 | −l6 Mesh | CCMD HIP | 6 | 475 | 530,433 |
| MFG 43 | −16 Mesh | CCMD HIP | 6 | 541 | 581,496 |
| MFG 44 | −16 Mesh | CCMD HIP | 5 | 548 | 594,488 |
| MFG 40 | −35 Mesh | CCMD HIP | 5 | 576 | 597,554 |
| MFG 41 | −35 Mesh | CCMD HIP | 6 | 534 | 605,380 |
| MFG 42 | −35 Mesh | CCMD HIP | 3 | 461 | 536,318 |
| MFG 69 | −35 Mesh | CCMD HIP | 15 | 617 | 674,567 |
| MFG 70 | −35 Mesh | CCMD HIP | 15 | 589 | 632,467 |
| MFG 61 | −35 Mesh | CCMD HIP | 6 | 506 | 570,455 |
| MFG 71 | −35 Mesh | CCMD HIP | 15 | 463 | 551,360 |
| MFG 72 | −35 Mesh | CCMD HIP | 12 | 455 | 550,361 |
| MFG 105 | −35 Mesh | CCMD HIP | 15 | 517 | 596,400 |
| MFG 106 | −35 Mesh | CCMD HIP | 15 | 484 | 583,441 |
| MFG 107 | −35 Mesh | CCMD HIP | 15 | 505 | 574,428 |
| MFG 108 | −35 Mesh | CCMD HIP | 13 | 506 | 596,405 |
| MFG 109 | −35 Mesh | CCMD HIP | 75 | 559 | 630,422 |
| MFG 73 | −35 Mesh* | CCMD HIP | 15 | 454 | 530,228 |
| MFG 105A | −35 Mesh* | CCMD HIP | 15 | 543 | 579,496 |
| MFG 106A | −35 Mesh* | CCMD HIP | 15 | 495 | 565,418 |
| MFG 107A | −35 Mesh* | CCMD HIP | 15 | 449 | 530,393 |
| MFG 72 | −35 Mesh** | CCMD HIP | 15 | 467 | 527,386 |
| MFG 72 | −35 Mesh** | CCMD HIP | 14 | 459 | 600,350 |
| MFG 72 | −35 Mesh** | CCMD HIP | 15 | 450 | 543,330 |
| MFG 66 | −35 Mesh | WIP/HIP | 15 | 439 | 528/361 |
| MFG 67 | −35 Mesh | WIP/HIP | 15 | 429 | 541,299 |
| MFG 68 | −35 Mesh | WIP/HIP | 15 | 488 | 577,344 |
| MFG 69 | −35 Mesh | WIP/HIP | 15 | 597 | 645,525 |
| MFG 70 | −35 Mesh | WIP/HIP | 30 | 569 | 594,459 |
| MFG 105 | −35 Mesh | WIP/HIP | 15 | 466 | 539,253 |
| MFG 106 | −35 Mesh | WIP/HIP | 15 | 446 | 525,353 |
| MFG 107 | −35 Mesh | WIP/HIP | 15 | 404 | 504,245 |
| MFG 108A | −35 Mesh | WIP/HIP | 29 | 448 | 562,322 |
| MFG 108B | −35 Mesh | WIP/HIP | 30 | 443 | 518,269 |
| MFG 109 | −35 Mesh | WIP/HIP | 60 | 525 | 593,431 |

−35 Mesh*: Finer than normal distribution.
−35 Mesh**: Various mixtures of −35 mesh and −100 mesh powder.

As may be seen from the Table 2 data, product that was initially screened to −35 mesh and was consolidated by the CCMD HIP showed individual test results of bend fracture strengths up to 674 ksi. The averages ranged from a low of 449 ksi to a high of 617 ksi. The minimum bend fracture strength test results are not characteristics of the practice. These low results were caused by large exogeneous inclusions present at the bend fracture surfaces.

The exogenous inclusions were identified as either slag or refractory particles. The slag originated from oxidized material as a result of exposure to air during melting. The refractory originated from erosion during the melting and the pouring of the alloy prior to atomization. They thus originated during melting and it is their presence that caused the low bend fracture results.

These low results are caused, therefore, not by the consolidation practice, but by the melting practice, and are not characteristic of the properties typically resulting from use of the consolidation practice. The maximum bend fracture strength of the product consolidated by the WIP/HIP method was 645 ksi, which is only slightly below the maximum value from the CCMD HIP. The average bend fracture strength values using WIP/HIP ranged from a low of 404 ksi to a high of 597 ksi. There is some difference between the CCMD HIP and the WIP/HIP process, but it is quite small. The low minimum values are caused by melting, not consolidation, so it is the high value of the averages that is most significant. Because productivity was much greater using the WIP/HIP process, and the capital equipment necessary to practice it costs much less than that required for CCMD HIP, there is an economic advantage to the method in accordance with the invention. Both the maximum values and the average bend fracture strengths of the two consolidation methods are comparable. These data clearly show that the WIP/HIP consolidation method yielded high bend fracture strength results.

A smaller number of trials was run on M4HC produced by the same practice as used in the production of M4HCHS. Results from these trials are shown in Table 3.

TABLE 3

| M4HC | | | | | |
|---|---|---|---|---|---|
| | | | Bend Fracture Results | | |
| Trial Number | Powder Size | Consolidation Method | Tests | Average (ksi) | Max., Min. (ksi) |
| MFG 33 | −35 Mesh | CCMD HIP | 6 | 622 | 666,589 |
| MFG 34 | −35 Mesh | CCMD HIP | 6 | 606 | 647,581 |
| MFG 35 | −35 Mesh | CCMD HIP | 6 | 622 | 639,577 |
| No Number | −35 Mesh | CCMD HIP | 6 | 708 | 732,658 |
| MFG 36 | −35 Mesh | CCMD HIP | 6 | 612 | 627,595 |
| MFG 37 | −35 Mesh | CCMD HIP | 6 | 615 | 653,550 |
| MFG 38 | −35 Mesh | CCMD HIP | 4 | 663 | 695,607 |
| MFG 73 | −35 Mesh* | CCMD HIP | 15 | 454 | 530,228 |
| MFG 37 | −35 Mesh* | WIP/HIP | 3 | 580 | 615,493 |

Two observations can be made: (1) the bend fracture strength of the lower sulfur (M4HC) material was significantly greater than for the high sulfur (M4HCHS) material, regardless of the consolidation method, and (2) the average bend fracture strength of the WIP/HIP material, while well above 500 ksi, was below that consolidated by CCMD HIP.

Table 4 shows the data from trials of 1 V alloy produced by the same practice as M4HCHS.

TABLE 4

| 10 V | | | | | |
|---|---|---|---|---|---|
| | | | Bend Fracture Results | | |
| Trial Number | Powder Size | Consolidation Method | Tests | Average (ksi) | Max., Min. (ksi) |
| MFG 7 | −35 Mesh | CCMD HIP | 48 | 572 | 651,331 |
| MFG 8 | −35 Mesh | CCMD HIP | 48 | 578 | 651,357 |
| MFG 45 | −35 Mesh | CCMD HIP | 18 | 562 | 656,348 |
| MFG 46 | −35 Mesh | CCMD HIP | 18 | 563 | 644,361 |
| MFG 47 | −35 Mesh | CCMD HIP | 12 | 550 | 640,386 |
| MFG 48 | −35 Mesh | CCMD HIP | 12 | 558 | 645,402 |
| MFG 52 | −35 Mesh | CCMD HIP | 12 | 602 | 649,551 |
| MFG 53 | −35 Mesh | CCMD HIP | 24 | 615 | 663,552 |
| MFG 55 | −35 Mesh | CCMD HIP | 11 | 616 | 663,552 |
| MFG 61 | −35 Mesh* | CCMD HIP | 12 | 587 | 663,552 |

TABLE 4-continued

10 V

| Trial Number | Powder Size | Consolidation Method | Bend Fracture Results Tests | Average (ksi) | Max., Min. (ksi) |
|---|---|---|---|---|---|
| MFG 63 | −35 Mesh* | CCMD HIP | 15 | 550 | 621,385 |
| MFG 65 | −35 Mesh* | CCMD HIP | 3 | 610 | 646,592 |
| MFG 63 | −35 Mesh* | WIP/HIP | 20 | 540 | 612,409 |
| MFG 49 | −35 Mesh | CSMD HIP | 6 | 456 | 523,405 |

These results show that WIP/HIP consolidation gave average bend fracture strengths for this alloy that are lower than the CCMD HIP consolidation, but significantly above the CSMD HIP. The values below 500 ksi with the CCMD HIP or WP/HIP consolidation had large exogenous inclusions in the fracture surface, as a result of the melting practice. The maximum strength values showed that the WIP/HIP method gave strengths about 50 ksi lower than CCMD HIP, but still well above the 500 ksi minimum.

All of the WIP/HIP trials discussed above used a temperature of 1400° F. for the pre-compacting temperature. This temperature was chosen based on work that is described hereafter. In all of the above disclosed cases, the loaded compacts were externally heated and transferred to the pressure vessel and the pressure was quickly raised to 11,000 psi. After this pre-compaction step, the compacts were each transferred to a furnace operating at 2150° F. equalized, and then transferred to the pressure vessel.

The vessel was sealed and quickly pressurized to 14,000 psi. The consolidated compacts, regardless of the consolidation method, were all thermo-mechanically processed to about 85% reduction from their original size before the bend fracture strength was tested.

Experimental work was carried out on the effect of heating at various temperatures prior to conventional consolidation (CCMD HIP). M4HCHS powder screened to −35 mesh was loaded into 5" diameter cans, sealed, and heated for five hours at temperatures ranging from 1400 to 2185° F. After holding at this temperature, the compacts were given conventional (CCMD HIP) consolidation with final temperature and pressure of 2185° F. and 14,000 psi, respectively. Bend fracture strength tests were run in the as-HIP condition, and after hot working with an 82% reduction in area from the original compact size. Test results are given in Table 5.

TABLE 5

Bend Fracture Test Results on Pre-Heated Powder

| Powder Source | Pre-Heat Temperature (° F.) | As-HIP Bend Fracture (ksi) | Hot-Worked Bend Fracture (ksi) |
|---|---|---|---|
| A | No Hold | 492 | 603 |
| | 1400 | 501 | 602 |
| | 1600 | 452 | 605 |
| | 1800 | 453 | 601 |
| | 2000 | 429 | 579 |
| | 2185 | 367 | 582 |
| B | No Hold | 529 | 647 |
| | 1400 | 547 | 643 |
| | 1600 | 426 | 642 |
| | 1800 | 446 | 601 |
| | 2000 | 405 | 578 |
| | 2185 | 362 | 567 |

These results show that when unconsolidated power was held at temperature above 1400° F. bend fracture strenghts in the as-HIP condition were lowered. When tested after an 82% reduction by hot working, bend fracture strenghts were not lowered until the powder is held at temperatures in excess of 1600° F. As a result of these data, all heating for the pre-compaction was done at 1400° F. as previously stated.

To determine the reason for this degradation in bend fracture strength, a determination had to be made as to whether heating at these different temperatures had any effected on the sulfide and oxide distribution, both in the as-HIP condition and after hot working. The results of this examination are given in Table 6.

TABLE 6

Sulfide Distribution on Pre-Heated Powder

| Powder Source | Pre-Heat Temperature (° F.) | Sulfide Distribution As-HIP Area | Sulfide Distribution As-HIP Max.Size | Sulfide Distribution Hot Worked Area | Sulfide Distribution Hot Worked Max. Size |
|---|---|---|---|---|---|
| B | No Hold | 225 | 3.61 | 253 | 6.56 |
| | 1400 | 152 | 2.59 | 124 | 5.85 |
| | 1600 | 185 | 3.38 | 343 | 13.34 |
| | 1800 | 315 | 4.19 | 402 | 5.76 |
| | 2000 | 540 | 5.06 | 656 | 9.43 |
| | 2185 | 993 | 10.78 | 1071 | 18.53 |

These data show that if the pre-heat temperature is 1600° F. or higher, the total sulfide area increased, the increase was greater with a higher hold temperature. This is shown for both the as-HIP as well as the hot worked condition. It is well known that larger inclusions as well as larger total area of inclusions cause a degrease in bend fracture strength. Microstructural examination of the effect of pre-heat temperature on oxide growth showed no apparent increase in the size of the oxides for pre-heat temperatures up to 2000° F. but at pre-heat temperatures above 1600° F. there was a noticeable outlining of the prior particle boundaries indicating the beginning of an increased concentration of oxides. For these reasons, all production trial compacts were pre-heated at 1400° F. but could have been pre-heated up to 1600° F. without any detrimental affect.

Other embodiments of the present invention will be apparent to those skilled in the art from consideration of the specification and practice of the invention disclosure herein. It is intended that the specification and examples be considered as exemplary only, with a true scope and spirit of the invention being indicated by the following claims.

What is claimed is:

1. A method for producing compacted, fully-dense articles from atomized tool steel alloy particles, comprising placing said particles in an evacuated, deformable container, isostatically pressing said particles within said container at an elevated temperature to produce a precompact having an intermediate density, heating said precompact to a temperature above said elevated temperature used to produce said precompact, and isostatically pressing said heated precompact to produce said fully-dense article.

2. The method of claim 1, wherein said elevated temperature used to produce said precompact is up to 1600° F.

3. The method of claim 1, wherein said elevated temperature used to produce said precompact is up to 1800° F.

4. The method of claim 1, wherein said heating of said precompact is performed outside an autoclave used for said isostatic pressing of said precompact to produce said fully-dense article.

5. The method of claim 1, wherein said atomized tool steel alloy particles are gas-atomized particles.

6. The method of claim 1, wherein said atomized tool steel alloy particles are nitrogen gas-atomized particles.

7. The method of claim 1, wherein said fully dense-article has a minimum bend fracture strength of 500 ksi after hot working.

8. The method of claim 1, wherein heating to said elevated temperature prior to said pressing to produce said precompact is performed outside an autoclave used for said pressing.

9. A method for producing compacted, fully-dense articles from atomized tool steel alloy particles, comprising placing said particles in an evacuated, deformable container, heating said particles to an elevated temperature and isostatically pressing said heated particles within said container to produce a precompact having an intermediate density, said heating being conducted outside an autoclave used for said pressing, heating said precompact to a temperature above said elevated temperature used to produce said precompact, and isostatically pressing said heated precompact to produce said fully-dense article, said heating of said precompact being conducted outside an autoclave used for said pressing to produce said fully-dense article.

10. The method of claim 8, wherein said elevated temperature used to produce said precompact is up to 1600° F.

11. The method of claim 9, wherein said elevated temperature used to produce said precompact is up to 1800° F.

12. The method of claim 9, wherein said fully-dense article has a minimum bend fracture strength of 500 ksi after hot working.

13. The method of claim 9, wherein said atomized tool steel alloy particles are gas-atomized particles.

14. The method of claim 5 or 13, wherein said gas-atomized particles are maintained in a nonoxidizing atmosphere prior to said placing said particles in said evacuated, deformable container.

15. The method of claim 14, wherein said gas-atomized particles are exposed to a uniform vacuum prior to said placing said particles in said evacuated, deformable container.

16. A method for producing compacted, fully-dense articles from atomized tool steel particles, comprising providing a quantity of atomized tool steel alloy particles within a sealable container, evacuating said container to provide a vacuum therein, evacuating a deformable container to produce a vacuum therein, introducing said alloy particles from said evacuated container to said evacuated deformable container through a sealed evacuated conduit, isostatically pressing said alloy particles within said deformable container at an elevated temperature to produce a precompact having an intermediate density, heating said precompact to a temperature above said elevated temperature used to produce said precompact and isostatically pressing said heated precompact to produce said fully-dense article.

17. The method of claim 16, wherein said pressing of said alloy particles is performed without outgassing of said container after evacuation thereof.

18. The method of claim 16, wherein said elevated temperature used to produce said precompact is up to 1600° F.

19. The method of claim 16, wherein said elevated temperature used to produce said precompact is up to 1800° F.

20. The method of claim 16, wherein said heating of said precompact is performed outside an autoclave used for said isostatic pressing of said precompact to produce said fully-dense article.

21. The method of claim 16, wherein said atomized tool steel alloy particles are gas-atomized particles.

22. The method of claim 16, wherein said atomized tool steel alloy particles are nitrogen gas-atomized particles.

23. The method of claim 18, wherein said fully-dense article ha s a minimum bend fracture strength of 500 ksi after hot working.

24. The method of claim 20, wherein said heating to said elevated temperature prior to said pressing to produce said precompact is performed outside an autoclave used for said pressing.

* * * * *